United States Patent [19]

Smack, Sr. et al.

[11] Patent Number: 4,616,829

[45] Date of Patent: Oct. 14, 1986

[54] APPARATUS FOR SIMULATING RUNNING GAMES

[75] Inventors: Melvin F. Smack, Sr., Valinda; Garland J. Semien, Jr., Los Angeles, both of Calif.

[73] Assignee: World Inventions, Valinda, Calif.

[21] Appl. No.: 595,913

[22] Filed: Apr. 2, 1984

[51] Int. Cl.[4] ..... A63F 9/14

[52] U.S. Cl. ..... 273/86 B; 272/DIG. 9; 273/85 G

[58] Field of Search ..... 273/86 R, 86 B, 1 GC, 273/86 F, 119 A, 129 R, 148 B; 446/129, 489; 272/69, 70, 73, 94, 96, 100, DIG. 5, DIG. 9; 128/25 B

[56] References Cited

U.S. PATENT DOCUMENTS

| | | | |
|---|---|---|---|
| 1,315,098 | 9/1919 | Doglione | 273/86 F |
| 1,513,251 | 10/1924 | Kennedy | 273/86 F |
| 2,493,755 | 1/1950 | Ferrill | 446/129 |
| 2,879,998 | 3/1959 | Paulos et al. | 273/86 F |
| 3,563,552 | 2/1971 | Korff | 273/238 |
| 3,709,493 | 1/1973 | Lally | 273/86 F |
| 3,834,702 | 9/1974 | Bliss | 273/86 B |
| 3,869,812 | 3/1975 | Arakelian et al. | 273/148 B |
| 4,278,095 | 7/1981 | Lapeyre | 273/148 B |
| 4,294,236 | 10/1981 | Hofstein | 272/96 |

OTHER PUBLICATIONS

Lord, M. et al., "Video Aid to Rehabilitation of Standing Balance", Med. and Biol. Eng. & Comp., May 1982, pp. 281–285.

*Primary Examiner*—Richard C. Pinkham
*Assistant Examiner*—MaryAnn Stoll Lastova
*Attorney, Agent, or Firm*—Limbach, Limbach & Sutton

[57] ABSTRACT

An apparatus for simulating running games wherein figurines are propelled about a track to simulate races and field events. In the preferred embodiment of the invention, the figurines are guided along slots in the track and have electric motors that are powered by control signals supplied from conductive strips paralleling the track. The control signals are preferrably supplied by a foot control unit that is operated by alternating foot motions of the user. With such an arrangement running games can be simulated which permit the physical dexterity and strategy of the user to affect the outcome of the contest.

17 Claims, 18 Drawing Figures

120V A.C.
86
88
84
RECTIFIER
RECT.
90
+V
82
V MOTOR

FOOT CONTROL A
FOOT CONTROL B
FOOT CONTROL C
RIGHT FOOT
LEFT FOOT
38
40
34
FOOT CONTROL D
24
28
42
66
+V
75K
74
1μF
72
74L121 MONOSTABLE M.V.
68
70
IN
OUT
76
DRIVE GENERATOR

DRIVE GEN.
78
V MOTOR
80
10
60B
60A
TRACK D
TRACK C
TRACK B

APPARATUS FOR SIMULATING RUNNING GAMES

DESCRIPTION

1. Technical Field

The present invention relates generally to games played by two or more people, and more particularly to an apparatus for simulating running games.

2. Background Art

In the past, there has been only a limited number of apparatus for simulating running games. Among these apparatus are the football games played with miniature figurines. The figurines were positioned on a vibrating surface which was configured as a football field wherein the vibration of the field caused the figures to move in random directions. In this game, there was a small amount of user control of the direction of each of the figurines by way of adjustable flanges at the bottom of the base for each figurine. These simulated football games involved very little user participation therein, and did not permit the physical dexterity or skill of the user to affect the performance of the figurines therein. As such, the user was often frustrated in his or her efforts to control the game pieces or figurines in a manner which realistically simulated the motions of the players in a football game.

Other games in which the user had a more direct effect upon the motion of the playing piece and which provided a motion which more realistically simulated the motion of the real-world object include slot-car racing. In this game, motorized miniature cars were propelled along a track wherein the propulsion is controlled by user-manipulated hand-held controls. As such, the user was able to realize the speed of automobile racing along with the direct control of the response of his or her slot car.

Heretofore, there has been no game in which running, or running-type competition is satisfactorily simulated, by the provision of game piece motion which realistically portrays the motion of a real-world runner, and by permitting the skill of the user to be translated into the user's chance of success in playing the game.

DISCLOSURE OF INVENTION

The aforementioned problems of prior games for simulating running are overcome by the present invention of an apparatus for simulating running contests comprising a track about which the running contest is conducted, movement indicator means positioned on the track indicating distance traveled by a contestant and means coupled to the movement indicator means for controlling the movement indicator means, including means operated by alternating control movements that are supplied by a user for generating control signals, wherein the amount of distance traveled that is indicated by the movement indicator means is a function of the control signal supplied from the controlling means.

In accordance with the present invention, the user operates a control, such as a foot control, with alternating movements. These alternating movements can be supplied by an up and down motion from the user's feet which provides an illusion of running, or can be provided by alternating hand motions. In response to each movement of the alternating foot or hand motions, a control signal is generated and supplied to the movement indicator means. The movement indicator means responds to each such control signal to indicate movement over a predetermined distance. As such, the number of control signals, and the rate of the control signals, provided by the user determines the cumulative distance indicated by the movement indicator means.

In the preferred embodiment of the present invention, the movement indicator means include a figurine which physically moves along the track in response to each control signal. Preferably, each activation of the control cicuitry by the user produces a single control pulse. Additionally, in the preferred embodiment of the present invention, the control unit includes two switch means, one of which is operated by the right-hand or foot of the user, and the other which is operated by the left-hand or foot of the user. It is preferred that control pulses are generated alternatively in response to activation of the control switches. For example, when the user depresses the right side control, a pulse is generated, but before another pulse can be generated in response to the depression of the right side switch, the left-side switch must be pressed to generate a control signal. As such, the movement indicator means will respond only if the user supplies a running type motion, i.e., alternating between activation of the right and left side switches, to the control unit. In this manner, a simulation of running is provided which more realistically simulates running action.

In order to further enhance the simulation of a running motion, means are provided so that the movement indicator, can indicate a side to side movement as well as a forward movement. This side to side movement is a function of the symmetry with which the user activates the left and right sides of the control unit. As such, user skill is required, not only to alternately activate the control unit at a high rate, but also to do so uniformly. In one embodiment of the present invention, the above feature is implemented by providing a figurine which is guided along a track by way of a groove/peg combination. A groove is positioned in the track and a peg is attached to the base of a figurine. The diameter of the peg is selected to be substantially less than the width of the groove so that the figurine can be oriented over a wide range of angles from the angle parallel to the groove in the track. If the user does not correctly space the control pulses to the movement indicator means, the movement indicator means will veer off to the side, thus averting a portion of the forward movement of the figurine.

In further embodiments of the present invention, inserts are provided in the track to simulate a hurdling type action in the movement of the movement indicator means, as well as to permit relay type running games to be simulated. In the prefered type embodiment of the present invention, the hurdling action is provided by positioning raised inserts on certain portions of the track so that the figurine or movement indicator means are required to pass over the inserts in order to continue movement along the track. If the movement indicator means does not have the proper forward motion, the figurine will not be able to "hurdle" the insert.

With respect to the relay simulating attachments, inserts are provided at selected portions along the track, which inserts can hold a first figurine in limbo until the insert is contacted by a second figurine, wherein the second figuring is moved along the track behind the first figurine. The impact of the second figurine on the insert enables the first figurine to begin movement along the track and prevents the second figurine from further movement along the track.

In a further embodiment of the present invention, means are provided at the end of an elongated segment of a track for imparting a vertical motion to a figurine which has been propelled along the track to the end of the track. The user controls the timing of the vertical motion component and is required to synchronize the arrival of his or her figurine at the end of the track with the application of the vertical motion thereof. In such a manner, a long jump or a high jump running game can be simulated.

It is therefore an object of the present invention to provide an apparatus for simulated running contests in which the user has direct control over the performance of his or her playing piece.

It is another object of the present invention to provide an apparatus for simulating a running contest wherein the user is required to supply an alternating motion in order to control his or her game piece.

It is a further object of the present invention to provide an apparatus for simulating running contests wherein movement indicator means are propelled along a track in response to control signals generated by alternating motions by the user.

It is still another object of the present invention to provide an apparatus for simulating a running contest wherein movement indicator means are propelled along a track and further wherein the track and movement indicator means are configured so that the movement indicator means can move from side to side in addition to forward movement.

It is a still further object of the present invention to provide an apparatus for simulating running contests which include inserts positioned along a track by which hurdling or relay type running games can be simulated.

It is another object of the present invention to provide an apparatus for simulating contests wherein a movement indicator means is propelled along a track including means positioned at the end of the track for imparting a vertical motion to the movement indicator means so that a high jump or a long jump contest can be simulated.

These and other objectives, features and advantages of the present will be more readily understood upon consideration of the following detailed description of certain prefered embodiments in the present invention and accompanying drawings.

DETAILED DESCRIPTION OF THE INVENTION

Figure 1:
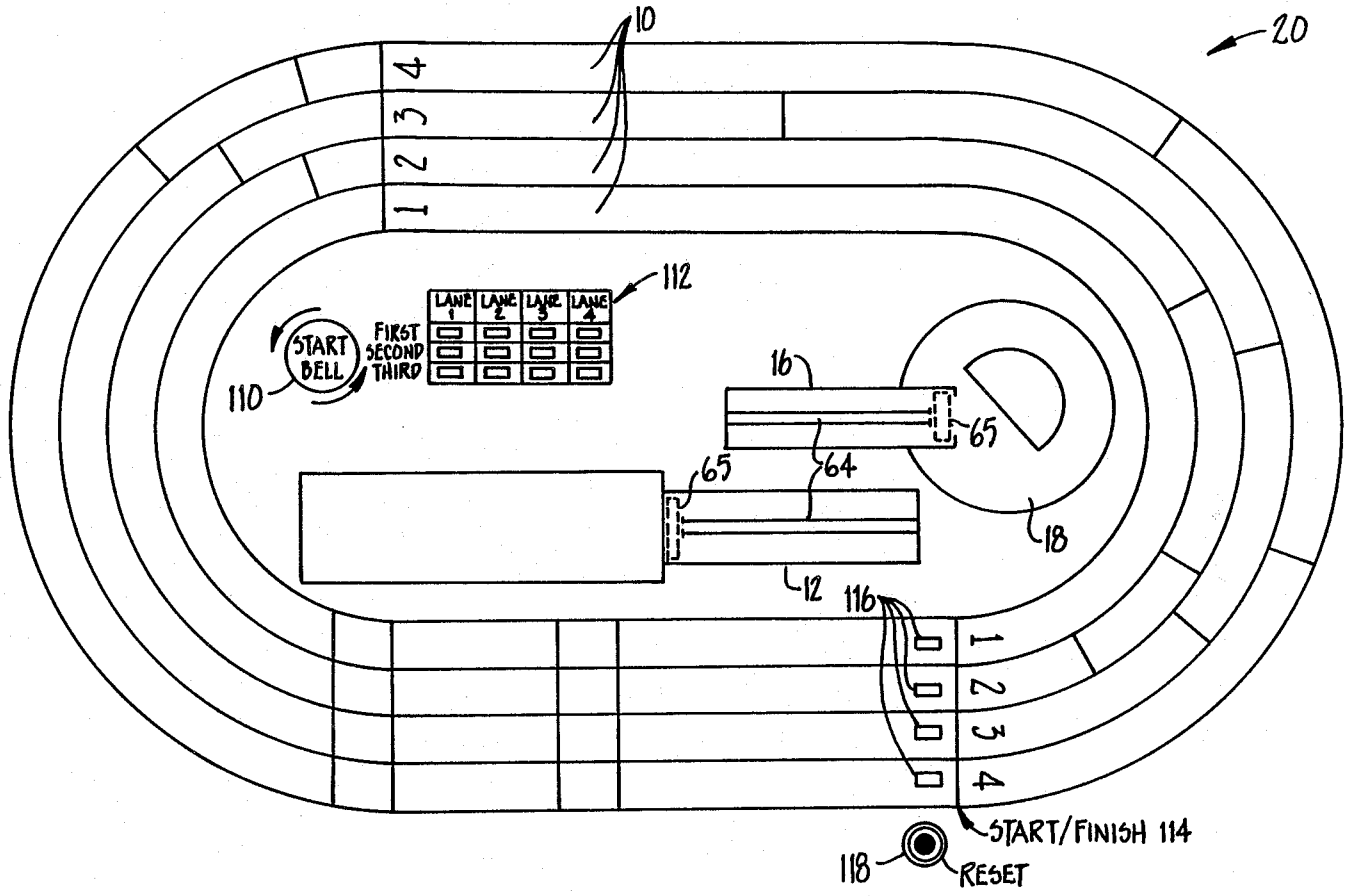
FIG. 1 is a diagram of a track suitable for use in one embodiment of the present invention.

Referring to FIG. 1, a track suitable for use in the present invention is shown. It is to be understood that, while an oval track is shown, there are numerous other track configurations which can be used, including figure-eight, linear, multi-elevation, and the like within the spirit of the present invention.

The track 20 includes a number of oval lanes 10 which are positioned toward the outer periphery of the track. The interior of the track 20 includes a runway 12 and pit 14 for the high jump event and a runway 16 and bar 18 for the high jump event.

Events, such as pure running events, hurdling events and relay events are simulated on lanes 10.

Figure 2:
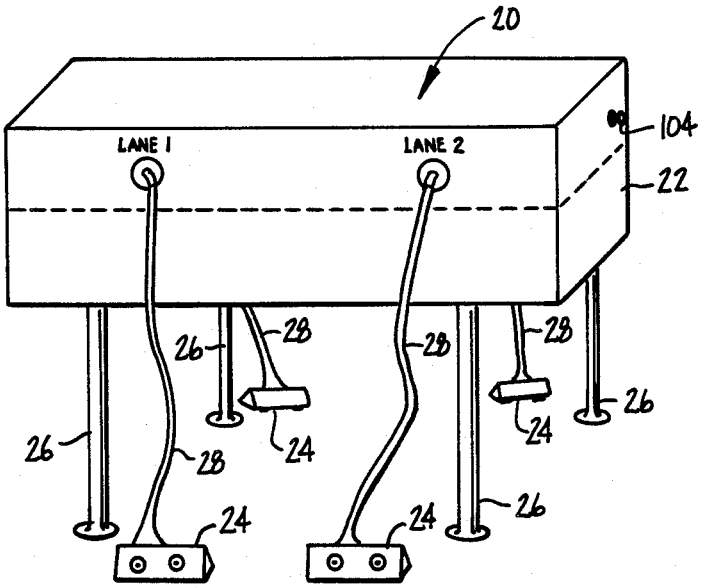
FIG. 2 is a simplified drawing of the physical arrangement of the present invention.

Referring to FIG. 2, a simplified depiction of the present invention is shown. There, the track 20 of FIG. 1 is positioned in a housing 22. Housing 22 is supported by legs 26, foot controls 24 are positioned on the floor and connected to housing 22 via signal lines 28.

In typical operation, the users seat themselves around housing 22, with their feet on a particular control unit. Motion indicator means, such as figurines are positioned on track 20. At an indicated starting point, the users begin operating their foot controls 24 to propel their respective figurines along the track. The first user to reach a designated point along the track is declared the winner.

Figure 3:
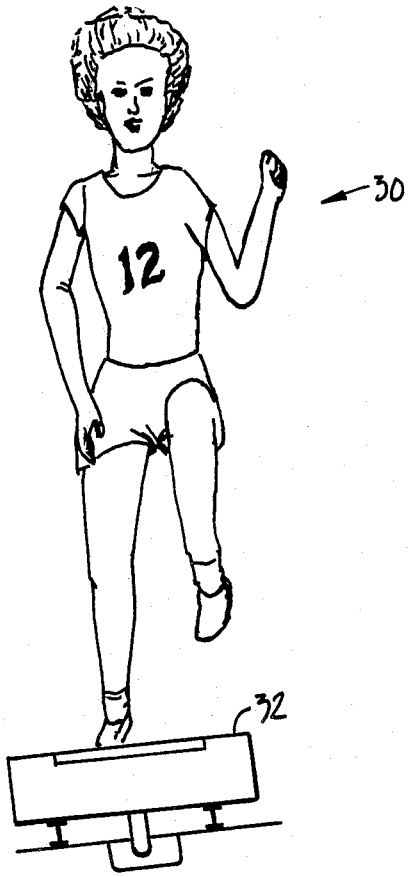
FIG. 3 is a simplified diagram of one embodiment of the movement indicating means of the present invention.

Referring now to FIG. 3, the preferred embodiment of the motion indicating means will be described in greater detail. In the preferred embodiment of the present invention, a figurine 30 is positioned upon a base 32. The base 32 contains the propelling mechanism by which the figurine 30 is moved along tracks 10. The figurines 30 can be constructed of plastic by diecasting or molding. Preferably, the figurines have arms which can move back and forth on hinges or at the shoulder as they are powered along the track 20. As such, the arms on each figurine will move back and forth in response to incremental movement of the base 32 along the track. This action adds to the illusion of running in the figurines. Preferably, the legs of the figurines are molded in the running position with one foot attached the base with corresponding leg extended, and the other leg raised bent at the knee. The figurine should be leaning slightly forward.

Figure 4:
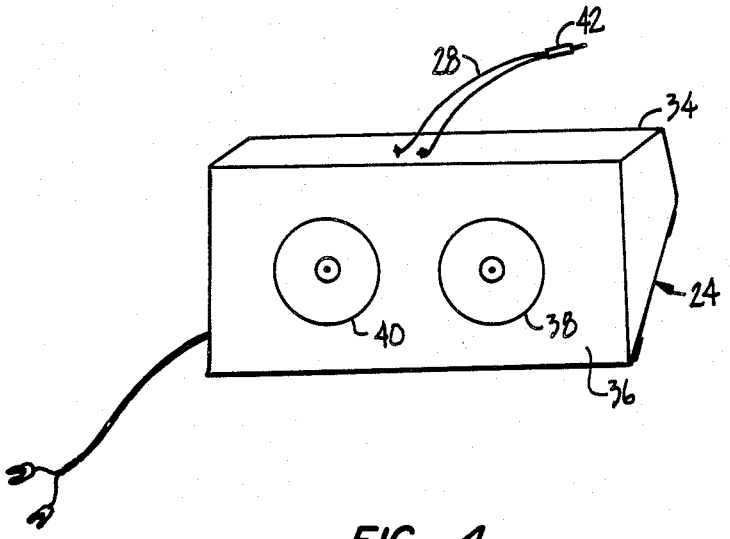
FIG. 4 is a plan view of a foot control unit of the present invention.

Referring to FIG. 4, the foot control unit 24 is illustrated. This unit includes a housing 34 having a face 36 upon which right and left foot switches, 38 and 40, respectively, are positioned. Preferably, the user's right foot is positioned over right switch 38 and the user's left foot is positioned over left switch 40. Depression of these switches by the user causes the generation of control signals. As shown in FIG. 4, signal lines 28 are provided from control unit 24 for connection to circuitry positioned in housing 22. In the preferred embodiment of the present invention, connection is made to housing 22 via jacks 42. These jacks can be phone, stereo jacks, such as is used with consumer electric equipment, or the like.

Preferably, right switch 38 and left switch 40 will be covered by a resilient guard to absorb the shock of the foot actuations. The guard also prevents contaminants from entering the foot control unit 24.

Figure 5A:
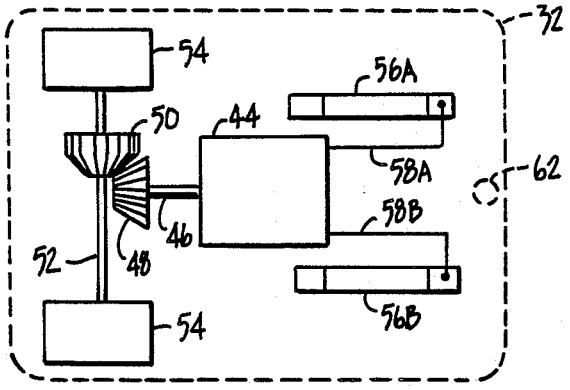
FIGS. 5*a*, 5*b* and 5*c* are top, side and front views, respectively, of a propulsion mechansim for one embodiment of the present invention.
Figure 5B:
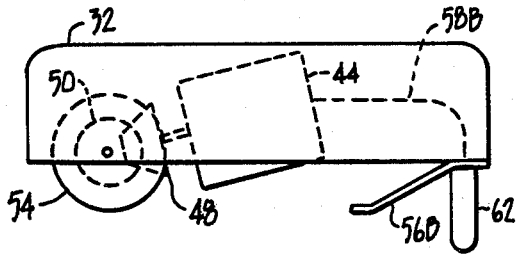
Figure 5C:
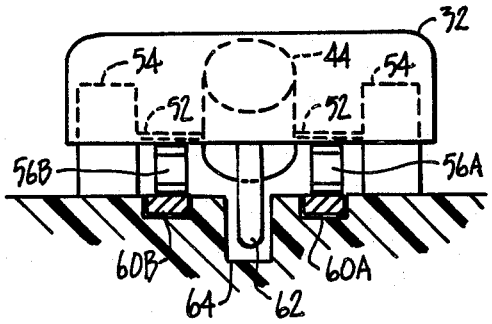

Referring to FIGS. 5*a*, 5*b* and 5*c*, the propulsion mechanism of base 32 will be described in greater detail. Referring to FIG. 5*a*, a top view of base 32 is shown. There, an electric motor 44 is supported in base 32. The electric motor shaft 46 turns a beveled gear 48. Beveled gear 48 communicates with a beveled gear 50 which is positioned on shaft 52. Positioned at the ends of shaft 52 are wheels or rollers 54. By this arrangement, the rotational motion of electric motor 44 is translated to rollers 54 which motion then propels base 32 along the track. The control signals for motor 44 are supplied via contacts 56*a* and 56*b*. One end of contact 56*a* is connected to motor 44 via line 58*a*, while one of contact 56*b* is connected to motor 4 via line 58*b*. The other end of contact 56*a* is shaped so that it rests upon a conducting strip that is positioned along the lane 10. Similarly, contact 56*b* is shaped so that its other end is positioned on a second contact positioned along the lane 10.

The above structure can be more readily seen in FIGS. 5*b* and 5*c*. In FIG. 5*c*, the conducting strips 60*a* and 60*b* which provide the control signals to contacts 56*a* and 56*b*, respectively, are shown. Preferably, the width of conducting strip 60*a* and 60*b* are wide enough to maintain contact with contacts 56*a* and 56*b* for the range of side movement of base 32.

Also shown in FIGS. 5*a*, 5*b* and 5*c* is guide peg 62. In the preferred embodiment of the present invention, guide peg 62, in conjunction with groove 64, permits base 32 to have a side way's motion. The diameter of guide peg 62 is selected to be substantially less than the width of groove 64 so that base 32 can veer from the forward direction of travel.

In operation, each of the lanes 10 includes a groove 64 and conducting strips 60*a* and 60*b*. The base 32 is positioned on the track so that guide peg 62 is disposed in groove 64, and so that contacts 56*a* and 56*b* are positioned on conducting strips 60*a* and 60*b*, respectively. When control signals are supplied to conducting strip 60*a* and 60*b*, the signals are supplied to motor 44 via contacts 56*a* and 56*b*, respectively. In response thereto, motor 44 causes beveled gear 48 to rotate by an amount related to the duration of the control signals, thereby causing rollers 54 to rotate by a corresponding amount. The platform 32 is thereby propelled a short distance along the lane 10.

Figures 6A, 6B:
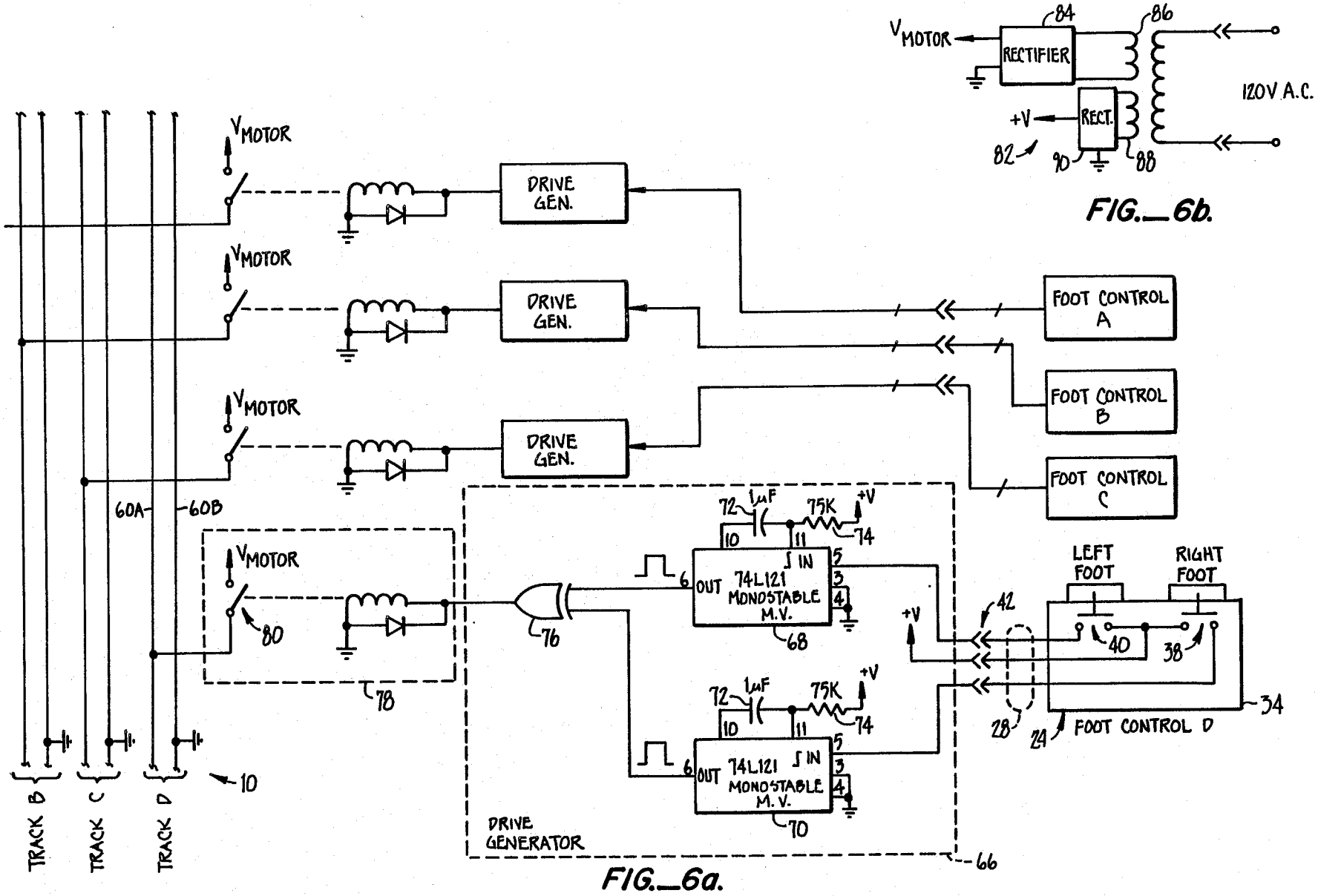
FIGS. 6*a* and 6*b* are a simplified schematic diagram of control signal generation circuitry of the present invention.

Referring to FIG.6*a* the generation of the control signals will be described in greater detail. In the preferred embodiment of the present invention, foot controls 24 are supplied for four users. It is to be understood that different numbers of foot controls can be provided within the scope of the present invention. In order to simplify the description of the present invention, signal generation due to the activation of foot control D will be explained in further detail, it being understood that the operation of the present invention for foot controls A, B, and C are identical.

In FIG. 6*a*, it can be seen that foot control D houses right switch 38 and left switch 40. These switches are preferably normally open, and are closed by application of pressure from the right or left foot, respectively. When the user closes one of the switches, the switch closure is transmitted to a drive generator 66, which is positioned in housing 22, via signal line 28 and jack 42. Signal line 28 provides a left switch 40 closure, a right switch 38 closure and a +V signal line between the foot control 24 and drive generator 66. Drive generator 66 includes a first monostable multivibrator 68 which is responsive to a switch closure from left switch 40 and a second monostable multivibrator 70 which is responsive to a switch closure from right switch 38. Each of the monostable multivibrators 68 and 70, in response to their respective switch closures, produces a control pulse having a predetermined duration. The duration of this control pulse is determined by the value of capacitor 72 and resistor 74. A commercially available monostable multivibrator, which is suitable for use in the drive generator is part No. 74L121, manufactured by Signetics Corporation of Sunnyvale, Calif. Preferably, monostable multivibrators 68 and 70 are edge triggered so that only a single pulse is generated for each switch closure. Thus, the user will not be able to merely hold right switch 38 or left switch 40 closed to cause the drive generator 66 to generate a continuous series of pulses. As such, the user is required to continuously open and close switches 38 and 40 in order to generate a series of control pulses.

In order to further the realism of the present invention, the control pulses from monostable multivibrators 68 and 70 are supplied to an exclusive-OR logic gate 76. As such, an output will be supplied from exclusive OR gate 76 only if the control pulses from monostable multivibrators 68 and 70 do not arise simultaneously. Thus, the user is required to depress right switch and left switch alternatively and sequentially in order to generate a series of control pulses out of drive generator 66. As such, in order to win a race, the user is required to provide foot speed, rather than power or strength. The closer the feet are to the control unit 24, the faster the feet can be pumped up and down. Additionally, the feet must be moved alternatively on each foot control switch. For each depression of the left or right switch 40 and 48, respectively, the figurine is moved by a predetermined distance along the track. To move the figurine in a running motion, the right and left switches 38 and 40 are required to be continuously open and closed. As the user raises his or her right foot off of the right control switch 38, his or her left foot should close left switch 40. As the user raises his or her left foot off of the left switch 40, his or her right foot should close right switch 38. If this can be done quickly, the figurine 30 will move along the lane 10 as if it is running, and the user will be effectively running in place.

While the drive signal generator 66 has been described in terms of monostable multivibrators 68 and 70, it is to be understood that other means for generating pulses of predetermined duration in response to a switch closure can be used with satisfactory results in the present invention. Among these other means are "step switches". When step switches are used, each depresion of the switch by one of the user's feet causes the switch to advance by a predetermined amount. The advancement of the switch supplies a momentary portion of power. This momentary portion of power is applied to the motor 44 to propel the figurine 30 along the track for a short distance.

Returning to FIG. 6*a*, the output of drive generator 76 is shown applied to the control coil of relay 78. Preferably, relay 78 is normally open and one contact is connected to the power supply for the motor, while the other contact is connected to one of the conducting strips of the track associated with the particular drive generator. In FIG. 6*a*, the contact of relay 78 is shown connected to conducting strip 60*a* of track D. In response to a pulse from drive generator 66, relay 78 connects the motor power to conducting strip 60*a* of track D. Note that conducting strip 60 b is connected to ground. Note also that at the end of the control pulse from drive generator 66, contacts 80 of relay 78 will open, thus removing the electric motor power from conducting strip 60*a*. When a series of control pulses are supplied by drive generator 66 to relay 78, relay 78 connects conductive strip 60*a* to the motor power supply in accordance with the series of control pulses. The faster the user alternates his or her right and left foot movements, the more closely spaced the control pulses will be, and the more rapidly will be the movement along the track of figurine 30.

Preferably, the pulse widths of the control pulses will be selected so that the amount of movement of figurine 30 for each pulse width will correspond to a single stride of the typical runner, when taken in proportion to the size of the lanes 10. This can be accomplished in several ways, including adjusting the gearing ratios between beveled gears 48 and 50 in base 32, as well as selecting the diameter of rollers 54. Additionally, the pulse widths of the control pulses can be selected by choosing the value of capacitors 72 and resistors 74. When commercial part number 74L121 is utilized for the monostable multivibrator function, the value of one microfarad for the capacitor, and 75K ohms for the resistor will provide a 50 millisecond control pulse width.

As can be seen from FIG. 6*b*, power for the drive generator circuitry is supplied from power supply 82. Power supply 82 can be positioned in housing 22. Power supply 82 receives power from the typical household outlet, or from a battery pack. A motor power voltage is derived via rectifier 84 and secondary winding 86 to power the motors 44. A second transformer winding 88 and rectifier 90 are utilized to derive the power supply for the drive generator circuitry 66.

Alternatively, foot controls 24 can be configured so that each foot control is supplied with power from a power pack (not shown). The foot control then supplies the requisite power to run the electric motors 44.

In order to further enhance the realism of the simulated running where a plurality of figurines are simultaneously propelled along tracks 10, the distance travelled by a particular figurine in response to a control pulse can be varied. The simplest way to accomplish this is to modify the diameter of the rollers 54. Thus, where a series of running contests are being simulated wherein teams of runners are participating, for example, four members per team, the relative speed of each of the members of the particular team can be varied by appropriately selecting the diameter of the roller 42 for each of the runners in a team. As such, the user is required to strategize his or her selection of runners to participate in a particular event.

For example, each figurine on each team could be allowed to run only two events. Before the start of the game or track meet, each contestant or user will be required to write down on line-up sheets the runners for each running event.

Each of four figurine on each team is designed to move at a different speed. Thus, the user is presented with speed variables that occur under actual competitive racing condition. This variability can often determine the winner of a close race.

An alternative way of varying the speed of a particular runner is to construct the figurines of different amounts of plastics or other materials so that the faster runner will have the least amount of plastic or other material and the slowest runner will have the largest amount of plastic or other material.

The material used for the game board and the track itself can be made of a hard, light plastic, painted the color of and style to represent a dirt track. The color red can be used to represent a clay track, or dark gray to represent a tartan track, etc. As discussed above, each of the lanes 10 includes a groove 64 down its center to guide or maintain the figurines in their respective lanes. Bordering each side of the groove are conductive strips 60*a* and 60*b* for providing power to the electric motors 44 of the figurines 30.

The same groove and conductive strip configuration is utilized for the long jump runway 12, and the high jump runway 16.

The groove, as discussed above, is wide enough to allow both left and right veering of the figurines 30 as they move down the track. This veering is one of the factors provided by the present invention which increases the realism of the race simulation. The peg 62 on each figurine base 32 extends from base 32 into the groove 64. The width of the groove is preferably considerably wider than the width of the peg. This allows veering back and forth of the figurine in its respective lane. If two users have equal foot speed, and both have selected the fastest runner, the winner will be determined by the amount of veering that a particular user permits to occur. If the user's figurine is veering to the left or right at the finish line, and the other user's runner is pointed straight ahead, the other will win.

As described above, the present invention provides means by which at least three factors are required to be considered and overcome by the users of the invention in order to successfully simulate a running contest. These factors are: (1) the side-to-side veering of each figurine 30 in its respective lane, while being powered down the track; (2) the selection of appropriate runners in the team to run particular events; and (3) the natural foot speed ability of the user.

Figure 7:
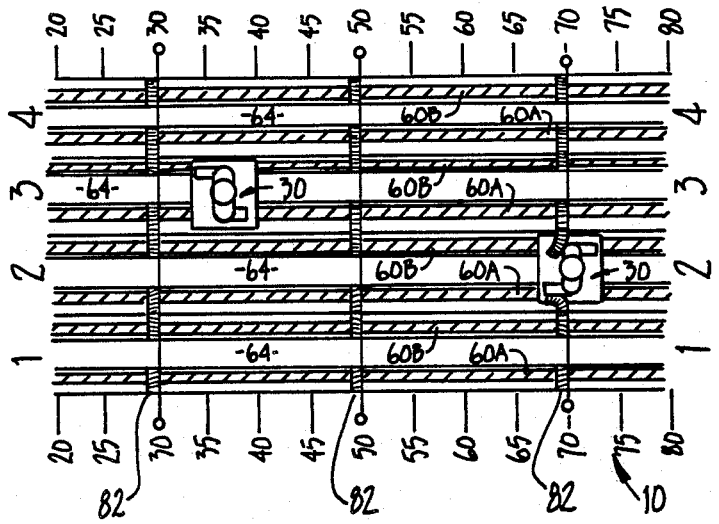
FIG. 7 is a top view illustrating the arrangement of inserts for simulating a hurdling contest.

In addition to the pure running events, the present invention permits a hurdling event and a relay event to be simulated. Referring to FIG. 7, the hurdling simulation will be described in further detail. FIG. 7 illustrates a top view of hurdle inserts 82 which are positioned in the lanes 10 along the track. One set of hurdles covers all four lanes across the track. Preferably, these hurdles 82 are constructed from an insulating material. Note that the hurdles cover the conductive strips 60*a* and 60*b* in each lane, so that in order to pass each set of hurdles, the figurine 30 is required to have a certain amount of speed and the proper direction.

Figure 8B:
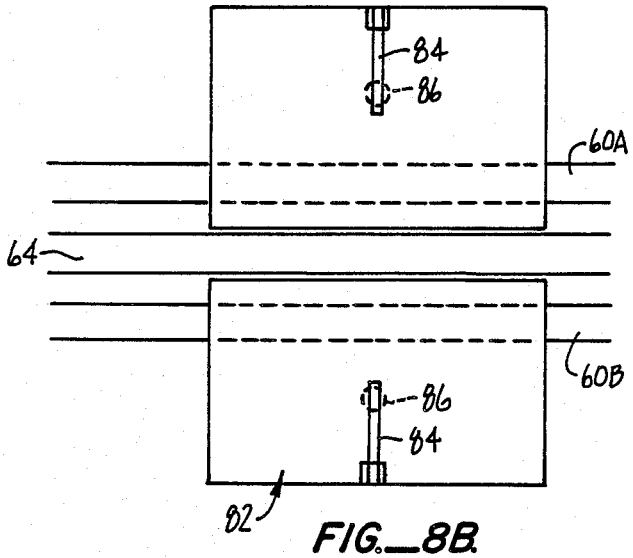
FIGS. 8*a*, 8*b*, and 8*c* are front, top and side views, respectively, of the hurdling arrangement.
Figure 8A:
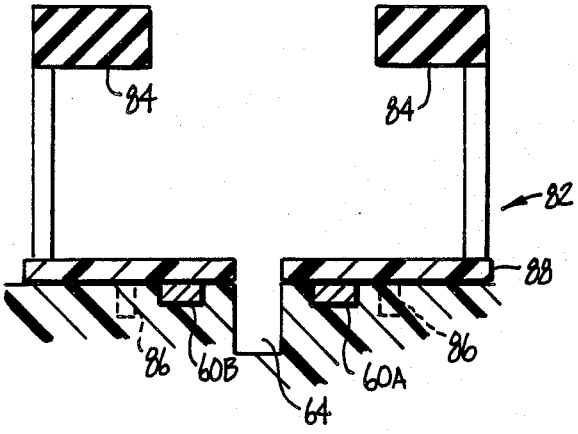
Figure 8C:
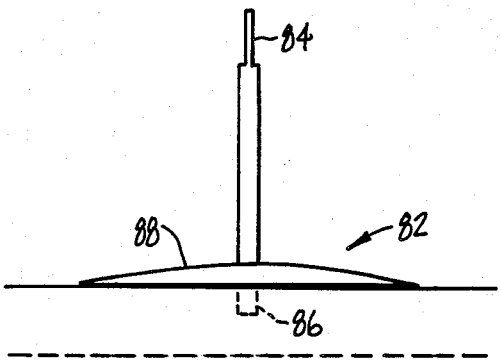

Referring to FIGS. 8*a*, 8*b* and 8*c*, the construction of the hurdles 82 will be described in greater detail. FIG. 8*a* provides a cut-away view of hurdles 82. It can be seen that the hurdles are constructed of an insulating material and extend over the conductive strips 60*a* and 60*b* for the particular lane. Hurdles 82 include a gate portion 84 which is positioned above the track and is open its center so as to permit the figurine 30 to pass through. Hurdles 82 have pegs 86 which are inserted into holes in the track.

FIG. 8*b* shows a top view of hurdles 82. As can be seen, hurdles 82 have a predetermined width so that the figurine 30 is required to have a certain amount of speed in order to be propelled over the insulating portion of the hurdle. If figurine 30 has insufficient speed, contacts 56*a* and 56*b* will be positioned out of contact with conductive strips 60*a* and 60*b*. As such, the figurine will not be able to overcome the hurdle 82.

FIG. 8*c* provides a side view of hurdle 82. Preferably, the insulating portion 88 of hurdle 82 has a convex shape so that it has greatest height at its center and minimum height at its ends. Thus, as the figurine 30 passes over insulating portion 88, the figurine is provided with the illusion of "jumping" over the hurdles. This configuration also requires the use of skill. For example, when a figurine passes through the hurdle going uphill, either the left or right side thereof, due to veering, a slight delay will result. On the other hand, if the figurine 30 passes through the center of the hurdle, the speed of the figurine thereto will be maximized.

Figure 9A:
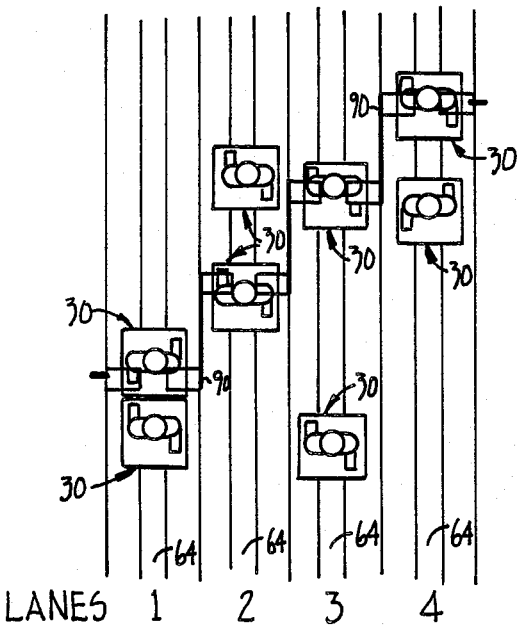
FIGS. 9*a* and 9*b* are simplified illustrations of the top and side views of a relay arrangement.
Figure 9B:
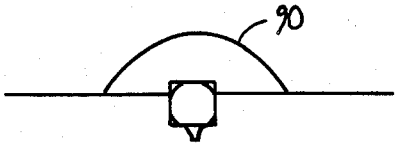

Referring to FIGS. 9*a* and 9*b*, a variation of the hurdling event is shown. Here, insulating inserts are positioned on the track at staggered distances to simulate a relay event. In this embodiment, an insulating insert 90 is positioned along selected portions of each of lanes 10. In the relay race, a plurality of runners paticipate for each team. At any one time, one runner for each team is running a portion of a leg of the relay race. When that runner has completed its leg, a second runner takes over and runs another leg of the race. In FIG. 9*a*, pairs of runners are shown in each lane. In lane 1, the bottommost runner has just completed its leg of the race and is nudging the uppermost runner to start that runner on the next leg of the race. In lane 2, the uppermost runner has already been nudged onto the track and has begun moving along the track. In lanes 3 and 4, the bottommost runners have yet to complete their legs, thus the uppermost runners are still positioned over inserts 90 waiting for contact by the bottommost runners. There are a number of ways in which the uppermost runners can be blocked from moving until contact from the bottommost runners are received. As shown in FIG. 9*a*, the uppermost runners are positioned so that their contacts 56*a* and 56*b* are out of contact with conducting strips 60*a* and 60*b*, respectively. When the bottommost runners make contact with the uppermost runners, the contacts of the uppermost runners are nudged into contact with conducting strips 60*a* and 60*b*. An alternative method for retaining the uppermost runners in position is to have the height of insert 90 large enough to block the figurine 30 from moving forward until it receives an additional push from the bottommost figurine. As such, after the bottommost figurine has pushed the uppermost figurine over insert 90, the bottommost figurine will then be blocked from further movement down the track.

With respect to the former method for restraining the uppermost figurine, the width of insert 90 is selected to be large enough so that after the bottommost figurine has pushed the uppermost figurine onto the track, the contact 56*a* and 56*b* of the bottommost figurine will be positioned on the insert 90 and out of contact with conducting strips 60*a* and 60*b*.

In a further embodiment of the present invention, the simulation of field events is provided. Recall that, in FIG. 1, a long jump runway and a high jump runway are provided wherein means are provided that at the end of each runway for imparting a vertical motion to figurine 30. In operation, the figurine will be propelled down each runway through the motion of the user's feet, and when the figurine reaches the end of the runway, the means for vertical motion will be activated to cause the figurine to jump upward. If the forward motion of the figurine is properly synchronized with the activation of the vertical motion means, the figurine will jump a significant height or a significant distance.

Figure 10A:
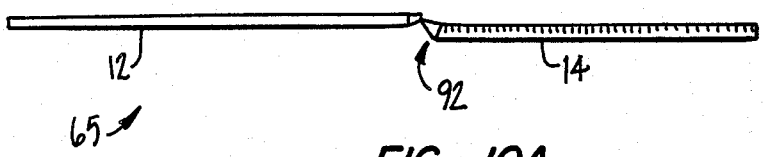
FIGS. 10*a* and 10*b* illustrate a long jump arrangement in accordance with the present invention.
Figure 10B:
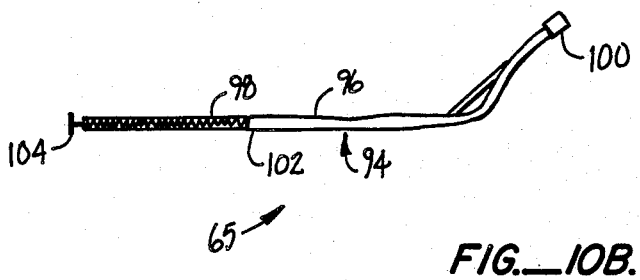

Referring to FIG. 10*a*, the vertical motion means will be described in greater detail. For the long jump, a spring board or take-off board 92 is provided slightly lower than runway 12. Spring board 92 is hinged to the end of runway 12 and a catapult 94 is positioned below spring board 92 to move spring board 92 in an upward direction. Referring to FIG. 10*b*, assembly 94 can be a rod 96 which is biased by spring 98. Rod 96 is angled upward so that its end 100 contacts spring board 92. The user holds on the other end 102 of rod 96 via knob 104. When the user releases knob 104, rod 96 imparts a vertical motion to spring board 92. If the figurine 30 is positioned over spring board 92 when knob 104 is released, the figurine will be knocked into the air on contact with the spring board. If the figurine 30 is positioned short of or beyond the spring board 92 when knob 104 is released, the distance that the figurine will travel will be reduced. Preferably, the width of spring board 92 is small so that additional skill will be required in order to position figurine 30 over the spring board at the moment of the release of catapult assembly 94.

A high jump simulation is provided in a similar manner. While in the long jump, it is preferable for the spring board 92 to be disposed at a 20 to 30 degree angle below horizontal when in the rest position, the high jump spring board is preferably between 40 and 43 degrees. This angle provides the figurine 30 with more of an upward, rather then outward, motion needed to get over the high jump bar. The high jump bar can be held by two plastic poles that fit into holes on the board.

While the means for guiding the figurine 30 along the track have been described in terms of a slot and figure portion, an alternative means of keeping the figurines in their respective lanes can employ magnetism. In such a configuration, the principle of magnetic repulsion is utilized. For example, a magnet is positioned on the figurine 30 so that a predetermined pole of the magnet is oriented in a downward direction. A magnetic field is generated on each side of the lane, the polarity of the magnetic field being the same as the polarity of the magnet in figurine 30. As the figurine veers to either side of the lane, the fields will oppose one another and cause the figurine to veer back towards the center of the lane.

Magnetism can also be used to propel the figurines 30 along the track. One possible arrangement would utilize substantially the same structure as that previously described, except that the base 32 of the propulsion mechanism supports a magnet. The figurine 30 is positioned on a separate base also attached to a magnet. The propulsion mechanism is guided along a slot or a groove as previously described; however, a separating sheet is positioned over the entire track. The figurine is then positioned on top of the sheet and aligned with the base for their respective propulsion means. The sheet acts to separate the figurine from the propulsion base 52, with the magnetic attraction between the magnet attached to the figurine and the magnet attached to the propulsion base acting as the coupling force. As the propulsion base is powered along its respective slot or groove as described above, the figurine, on top of the separating sheet, is pulled along the track.

An alternative magnetic propulsion arrangement can utilize a permanent magnet attached to the figurine, as described before. A series of electromagnets can be positioned along the track and, sequentially, energized by the foot controls and drive generator circuitry. As each coil is sequentially energized, the figurine which, again, is positioned on a separating sheet, is pulled along by the moving magnetic field generated by the sequentially activated coils.

In order to further enhance the realism of the present invention, a starting bell or starting indicator 110 is provided. Start bell 110 is shown in FIG. 1 as being positioned on the in-field portion of track 20. Start bell 110 can be a wind-up clock mechanism, such as is found in mechanical timers and the like. In use, the participants position the figurines at the starting point in their respective lanes and the start bell is wound and permitted to time out. At the point of time out, the start bell sounds a start signal, thus indicating the start of the race. It is to be understood that the start bell 110 can also be an electronic mechanism which, in addition, sounding an audible start signal, will also inhibit the players from activating their figurines until after the start signal has been sounded.

Also shown in FIG. 1 is an electronic finish line 112. This finish line serves to arbitrate any disagreements as to the order of finish of the contestants in close races. Preferably, the electronic finish line provides a visual indication of the order of finish for the first three finishers. This visual indication can take the form of lighted light emitting diodes or the like.

As shown in FIG. 1, the electronic finish line preferably provides four columns and three rows. Each column corresponds to a lane and each row corresponds to a particular order of finish. In the arrangement shown in FIG. 1, column 1 corresponds to lane 1 and the first row corresponds to the first to finish.

Figure 11:
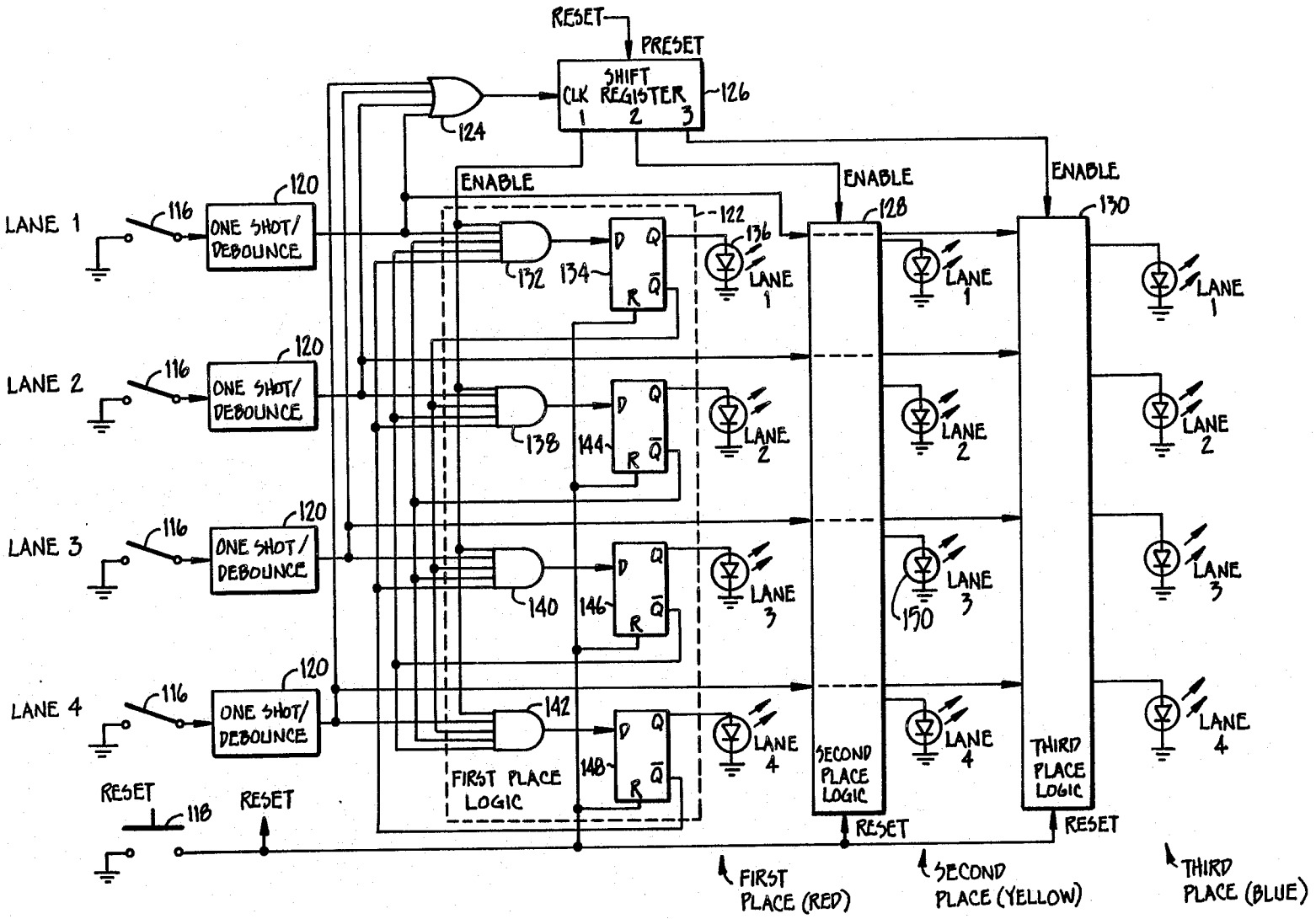
FIG. 11 illustrates the electronic finish line logic.

As each figurine crosses the finish line, see the bottom righthand corner of FIG. 1, an impulse is provided to finish logic circuitry, FIG. 11. Finish logic circuitry determines whether a particular impulse corresponds to a first, second or third place finish and lights the appropriate light emitting diode for the particular lane. After the figurines for all of the lanes have crossed the finish line, the electronic finish line 112 will display the order of finish.

Referring to FIGS. 1 and 11, one manner in which the electronic finish line 112 can be implemented will now be described in greater detail. In FIG. 1, to the left of the start/finish line 114, are located trip mechanisms 116. These trip mechanisms 116 can be mechanical switches, magnetically activated reed relays, magnetically activated hall effect switches, or the like.

The trip mechanisms are preferably located in the slot or groove in the center of each lane and to the left of the finish line. The distance between the trip mechanism and the finish line is selected to correspond to the distance between the front end of the figurine base 32 and the guide pin 62. Thus, when the trip mechanism 116 is activated, the front portion of the figurine will be just crossing the start/finish line 114.

Where mechanical type trip mechanisms are used, they should be as wide as the slots or grooves to allow for veering of the guide pin 62 from side to side.

Where the trip mechanisms 116 are electromagnetic, the pin 62 can be made of a permanent magnet material. Preferably, the permanent magnetic material will provide a strong enough magnetic field to activate the trip mechanism for all positions of the peg in the groove, i.e., whether the figurine has veered to the left or right side of the slot or groove 64.

At the end of the race, the electronic switchboard 112 is reset by depression of reset switch 118.

Referring more particularly to FIG. 11, the circuitry for implementing the electronic finish line 112 will be described in greater detail. In the figure, a mechanical type trip mechanism 116 is shown. When a particular trip mechanism is activated, the signal is provided to one shot/debounce circuitry 120. This circuitry eliminates switch bounce due to the closure of the mechanical switch 116 and also provide a pulse of predetermined duration.

In order to simplify the explanation herein, the operation of the trip circuit for lane 1 will be described, it being understood that the trip mechanisms for lanes 2, 3 and 4 operate in a similar fashion. The pulse generated by one shot/debounce 120 for lane 1 is provided to first place logic circuit 122 and OR gate 124. OR gate 124 responds to the pulse by applying a clock signal to shift register 126. Shift register 126 controls the operation of first place logic circuit 122, second place logic circuit 128, and third place logic circuit 130, such that when the first pulse is provided to the clock input of shift register 126, only first place logic circuit 122 is enabled. Thereafter, when the second pulse is received at the clock and input to shift register 126, only second place logic circuit 128 is enabled. Finally, when a third pulse is applied to the clock input of shift register 126, only third place logic circuit 130 is enabled.

Shift register 126 can be a presettable parallel/serial shift register. As such, when the user presses reset switch 18 to reset the electronic finish line 112, the contents of shift register 126 can be preset so that output 1 is at a logic 1 state, output 2 is at a logic 0 state, and output 3 is at a logic 0 state. As clock pulses are provided to shift register 126, the logic state that was at output 1 is clocked sequentially to output 2, and then to output 3, thus enabling the first, second and third place logic circuits as described above.

As can be seen from FIG. 11, the inputs to OR gate 124 are connected to the outputs of one shot/debounce circuits 120. Thus, whatever one shot/debounce circuit 124 in a particular lane provides a pulse, this pulse is passed to the clock input of shift register 126 by OR gate 124. Assuming for purposes of explanation, that trip mechanism 116 for lane 1 is the first to be activated. One shot/debounce circuit 120 provides a pulse to OR gate 124 as described above and to AND gate 132 of first place logic circuit 122. Note that a second input to AND gate 132 is provided by output 1 of shift register 126. The output of AND gate 132 is connected to the input of D flipflop 134. The noninverted output of D flipflop 134 is connected to light emitting diode 136. The inverted output of D flipflop 134 is connected to the inputs of AND gates 138, 140 and 142. Note that the reset input to D flipflop 134 is activated when reset switch 118 is closed by the user. This reset signal is also provided to D flipflop 144, 146, and 148. Thus, when the user presses reset switch 118 to initialize the electronic finish line 112, D flipflops 134, 144, 146 and 148 are reset so that their noninverting outputs provide a logic 0 and their inverting outputs provide a logic 1. Note that the other inputs to AND gate 132 are provided from the inverting outputs of D flipflops 144, 146 and 148. Thus, before any of the trip mechanisms 116 are activated, AND gates 132, 138, 140 and 142 are provided with inputs, all of which are at a logic 1 level, except for the signal provided by one shot/debounce circuit 120. Thus, when, for example, trip mechanism 116 for lane 1 is closed, the pulse from one shot/-debounce circuit 120 is applied to AND gate 132. Since all of the other inputs to AND gate 132 are at a logic 1 level, the output of AND gate 132 assumes a logic 1 state. This logic 1 state, when applied to the input of D flipflop 134, causes the noninverting output of D flipflop to assume a logic 1 level. Simultaneously, the inverted output of D flipflop 134 goes to a logic 0 level. In response to these changes, light emitting diode (LED) 136 is lighted. Simultaneously, a logic 0 is applied from the inverting output of D flipflop 134 to the inputs of AND gates 138, 140 and 142. This causes AND gates 138, 140 and 142 to ignore any pulse that might be provided thereto by their associated one shot/debounce circuit 120. Thus, the LED for the first place finisher will be lighted in the electronic finish line circuit 112.

As described above, OR gate 124 passes pulses from one shot/debounce circuit 120 to the clock input of shift register 126. When a pulse is presented, shift register 126 shifts the logic 1 state at its output to the next higher output. Thus, as the first place finisher is being registered in first place logic circuit 122, shift register 126 shifts its logic 1 output to output No. 2. In such a state, output No. 1 provides a logic 0 state as does output No. 3. As such, second place logic circuit 128 is enabled to sense the next occurring pulse.

Assuming, for purposes of this example, that the trip mechanism 116 for lane 3 is the next one tripped. It is to be understood that the circuitry for the second place logic circuit 128 and the third place logic circuit 130 are substantially identical to that shown in first place logic circuit 122. Thus, the pulse from one shot/debounce circuit 120 for lane 3 is applied to the associated AND gate of second place logic circuit 128. As with the first place logic circuit, when second place logic circuit 128 is enabled, all of the inputs, except for the one shot/-debounce input, are a logic 1 state. When the pulse from one shot/debounce circuit 120 for lane 3 is applied to its associated AND gate, a logic 1 state is passed to the associated D flipflop. In turn, that D flipfop provides a logic 1 at its noninverted output to light LED 150, while providing a logic 0 at its inverted output to gate off the AND gates for the other lanes. Simultaneously therewith, the pulse from one shot/debounce circuit 120 for lane 3 is supplied via OR gate 124 to the clock input of shift register 126. This causes the logic 1 output to be shifted from output No. 2 to output No. 3 of shift register 126. This disables second place logic circuit 128 and first place logic circuit 122, and enables third place logic circuit 130. In a manner similar to that described in conjunction with first place logic circuit 122 and second place logic circuit 128 above, third place logic circuit 130 registers the next occurring pulse to light the appropriate LED.

When the race is completed, and the user presses reset switch 118, all of the D flipflops in first, second and third place logic circuits 122, 128 and 130, respectively, are initialized, and shift register 126 is preset so that output 1 is at a logic 1 state and outputs 2 and 3 are at a logic 0 state.

The terms and expressions which have been employed here are used as terms of description and not of limitations, and there is no intention, in the use of such terms and expresions of excluding equivalents of the features shown and described, or portions thereof, it being recognized that various modifications are possible within the scope of the invention claimed.

We claim:

1. An apparatus for simulating a running contest comprising:

a track about which running contest is conducted;

movement indicator means positioned for movement on the track for indicating distance travelled by a contestant; and means coupled to the movement indicator means for controlling the movement indicator means, including means operated by depressive foot movements in the form of running that are supplied by a user for generating control signals, wherein the amount of distance travelled indicated by the movement indicator means is a function of the control signals supplied from the controlling means, wherein the controlling means includes:

first activating means operated by the depressive foot movement of one foot of the user for providing a first signal;

second activating means operated by the depressive foot movement of the other foot of the user for providing a second signal; and means coupled to the first and second activating means for transmitting control signals to the movement indicator means wherein the control signals are transmitted when either the first or the second, but not both activating means are being operated.

2. The apparatus of claim 1 wherein the track includes a slot having a predetermined width and further wherein the movement indicator means includes:

a figurine;

means coupled to the figurine and shaped for positioning in the slot for guiding the figurine along the slot;

means responsive to the control signals and attached to the figurine for propelling the figurine relative to the track; and means for supplying the control signals to the propelling means.

3. The apparatus of claim 2 wherein the guiding means includes an elongated finger which is attached to the figurine and which has a diameter that is significantly less than the width of the slot, so that the position of the figurine can vary transversely with respect to the slot.

4. The apparatus of claim 1 wherein the transmitting means transmit control signals whenever a predetermined order of foot movement is provided by the user.

5. The apparatus of claim 4 wherein the transmitting means includes means for prioritizing the response of the transmitting means to respond alternately to the right and then left foot movements of the user.

6. The apparatus of claim 1 wherein the first and second activating means each includes:

means operated by depressive foot movement of the user for providing a switch closure; and means responsive to the switch closure for generating a control signal of a predetermined duration.

7. The apparatus of claim 2 wherein the supplying means includes:

conductor means positioned along the slot in the track for receiving the control signals from the controlling means; and pick-up means positioned on the figurine and coupled to the propelling means for sensing the control signals in the conductor means.

8. The apparatus of 2 wherein the propelling means includes:

an electric motor which is responsive to the control signals for supplying rotational motion; and means for transferring the rotational motion from the electric motor to the track so that the figurine is propelled along the track, wherein the transferring means includes means for selecting a ratio by which the rotational motion of the electric motor is transformed to displacement of the figurine along the track.

9. The apparatus of claim 8 wherein transferring means includes:

a rotating member shaped for rolling along the track; and gearing means coupled to the electric motor and the rotating member for transferring the rotational motion of the electric motor to the rotating member.

10. The apparatus of claim 9 wherein the rotating member is a roller having a predetermined diameter, and further wherein the diameter of the roller determines the ratio by which the rotational motion of the electric motor is transformed into displacement of the figurine along the track.

11. The apparatus of claim 7 further including insulator means positioned over the conductor means at predetermined intervals along the track so as to decouple the pick-up means from the conductor means at those intervals.

12. The apparatus of claim 11 wherein the insulator means has physical dimensions which are selected so that, when the insulator means is positioned ahead of the movement indicator means, further displacement of the movement indicator means is inhibited upon contact with the insulator means, and further wherein the height of the insulator means is selected so that a first movement indicator means, when in contact with the insulator means, can be urged out of contact with the insulator means as a result of contact with a second movement indicator means that is propelled along the track behind the first movement indicator means.

13. The apparatus of claim 7 wherein the track has a starting point and an end point, further including means operable by the user for imparting a vertical velocity component to the figurine when the figurine is positioned in the vicinity of the end of the track.

14. The apparatus of claim 13 wherein the imparting means includes a catapult.

15. The apparatus of claim 1 further including means for indicating the start of the contest and for indicating the order-of-finish of the contest.

16. The apparatus of claim 15 wherein the start and order-of-finish indicating means include a wind-up timer which sounds an audible signal.

17. The apparatus of claim 15 wherein the start and order-of-finish means include an electronic finish line comprising means for visually indicating the order of finish by lane;

means positioned in each lane for generating a finish pulse when activated by the movement indicator means associated with the lane; and means coupled to the indicating means for controlling the indicating means as a function of the order in which finish pulses are received from each lane.

* * * * *